United States Patent [19]

Duran

[11] 4,295,674

[45] Oct. 20, 1981

[54] LATCH MECHANISM

[75] Inventor: John A. Duran, Glendora, Calif.

[73] Assignee: Avibank Mfg., Inc., Burbank, Calif.

[21] Appl. No.: 80,246

[22] Filed: Oct. 1, 1979

[51] Int. Cl.[3] ..... E05C 3/14

[52] U.S. Cl. ..... 292/190

[58] Field of Search ..... 292/101, 106, 190, 241, 292/242, 341.18; 70/432

[56] References Cited

U.S. PATENT DOCUMENTS

| | | | |
|---|---|---|---|
| 3,503,642 | 3/1970 | Poe | 70/432 X |
| 4,155,575 | 5/1979 | Poe | 292/190 |
| 4,213,642 | 7/1980 | Poe et al. | 292/241 |

*Primary Examiner*—Richard E. Moore

*Attorney, Agent, or Firm*—Poms, Smith, Lande & Rose

[57] ABSTRACT

A latch mechanism is disclosed which includes a housing in which a rotor assembly is rotatably journalled within the housing and rotatable between fully locked and unlocked positions. The rotor assembly is provided with a movable member or latching surface for latching to an eyebolt or the like. An indicator flag is slidably mounted in the rotor assembly and is restricted to common rotation with the rotor assembly. The flag is slidably movable between an extended position wherein a portion of the flag extends out of the rotor assembly and a recess position where the flag is not visible externally of the rotor assembly. The flag is biased to the extended position so that it remains extended and visible until the rotor assembly is moved to a fully locked position. The flag remains in the recessed position only when the rotor assembly is in the fully locked position. A plunger which is slidably mounted within the housing substantially perpendicular to the flag couples with the flag to prevent the flag and rotor assembly from rotating. The plunger can only be coupled with the flag when the rotor assembly is in the fully locked position and the flag is in the recessed position.

15 Claims, 12 Drawing Figures

20
22
24
26
28
30
32
33
34
36
38
40
48
54
60
78
80
86
88
90
XI
III

LATCH MECHANISM

BACKGROUND OF THE INVENTION

The present invention relates to latch assemblies which are provided with means for indicating whether the latch is in a locked or unlocked position. These latches are particularly useful for use on the exterior surfaces of aircraft where it is important that the latch present a flush surface with the aircraft body and also clearly indicate whether it is in the locked or unlocked position.

In general, latch assemblies of this type utilize an indicator or flag which remains in an up or protruding position while the latch is in the unlocked position. In the up position the flag is visible. When the latch assembly is in the locked position the indicator or flag is in the down or flush position and is not visible externally of the latch. The indicator or flag is generally provided in a contrasting color, so that individuals can readily ascertain whether or not the latch assembly is in a locked or unlocked position. This is especially critical in aircraft applications where an unlatched exterior door or hatch would be very hazardous during flight.

Due to the need for positive and secure latching on aircraft, the prior art latch assemblies utilize a rotary latching configuration. The rotor latch employs an irregular cam latching surface. As the irregular cam surface is rotated, it initially engages the surface to be latched. On continued rotation, the irregular cam surface draws the surface to be latched towards the center of the rotary latch assembly until it is rotated into the fully locked position. Prior art flags or visual indicators used on this type of latch may indicate that the latch is in the fully locked position when, in fact, it is in a condition of only partial locking. It is extremely important that the visual indicator or flag indicates a locked condition only when the latch is in a fully locked position.

Exemplary of such proir art latches is U.S. Pat. No. 3,503,642 issued to L. R. Poe on Mar. 31, 1970. This particular patent discloses a condition indicator utilizing a side arm catch and a complex spring actuated deflecting cam. The Poe patent also contains a "dead spot" where the latch may indicate that it is fully locked when, in fact it is not locked.

It would be desirable to have a latch mechanism which does not indicate a locked condition when the latch is only partially locked. The desired latch should indicate a locked condition only when the latch is fully locked and should indicate an unlocked condition when the latch is partially or fully unlocked. The indicator should also be simple in construction to provide a reliable indicator which is not subject to malfunction.

SUMMARY OF THE INVENTION

It is an object of the present invention to disclose and provide a latch mechanism having a visual indicator or flag which remains in the up and visual position at all times until the latch is definitely fully locked.

It is another object of the present invention to disclose and provide a latch, which once being in the fully locked position, is coupled to eliminate inadvertent unlocking of the latch. Another object of the present invention is to disclose and provide a latch which when mounted for its intended use on the exterior surface of an aircraft, presents a flush exterior surface.

A final object of the present invention is to provide a safe and convenient method of determining whether compartments on aircraft are in a fully locked or unlocked condition.

The above objects and others are accomplished by the present invention which utilizes a latching mechanism comprising a rotor assembly which is movable between a fully locked and an unlocked position.

The rotor assembly is provided with indicator means coupled thereto. The indicator means includes a first portion which is visible externally of the rotor assembly only when the rotor assembly is in the unlocked position. The first portion of the indicator means is not visible externally of the rotor assembly only when the rotor assembly is in the fully locked position.

In addition, rotation preventing means are provided for preventing rotation of the rotor assembly to its unlocked position when the first portion of the indicator means is not visible externally of the rotor assembly. This prevents inadvertent rotation of the rotor assembly until the first portion of the indicator means is moved to a position visible externally of the rotor assembly. The rotation preventing means may also be viewed as coupling means for coupling the flag and rotor assembly to the latch housing to prevent rotation of the rotor assembly.

The rotor assembly includes a movable member or irregular cam surface which moves between a retracted and unretracted position. The movable member is adapted to engage a latch member when the rotor assembly is in its fully locked position.

A more complete understanding of the latch mechanism in accordance with the present invention, as well as recognition of additional objects and advantages therefore, will be afforded to those skilled in the art by a consideration of the following detailed description of an exemplary embodiment thereof. Reference will be made to the appended sheets of drawings which will first be discussed briefly.

DETAILED DESCRIPTION OF THE PREFERRED EXEMPLARY EMBODIMENT

Figures 1, 2, 11:
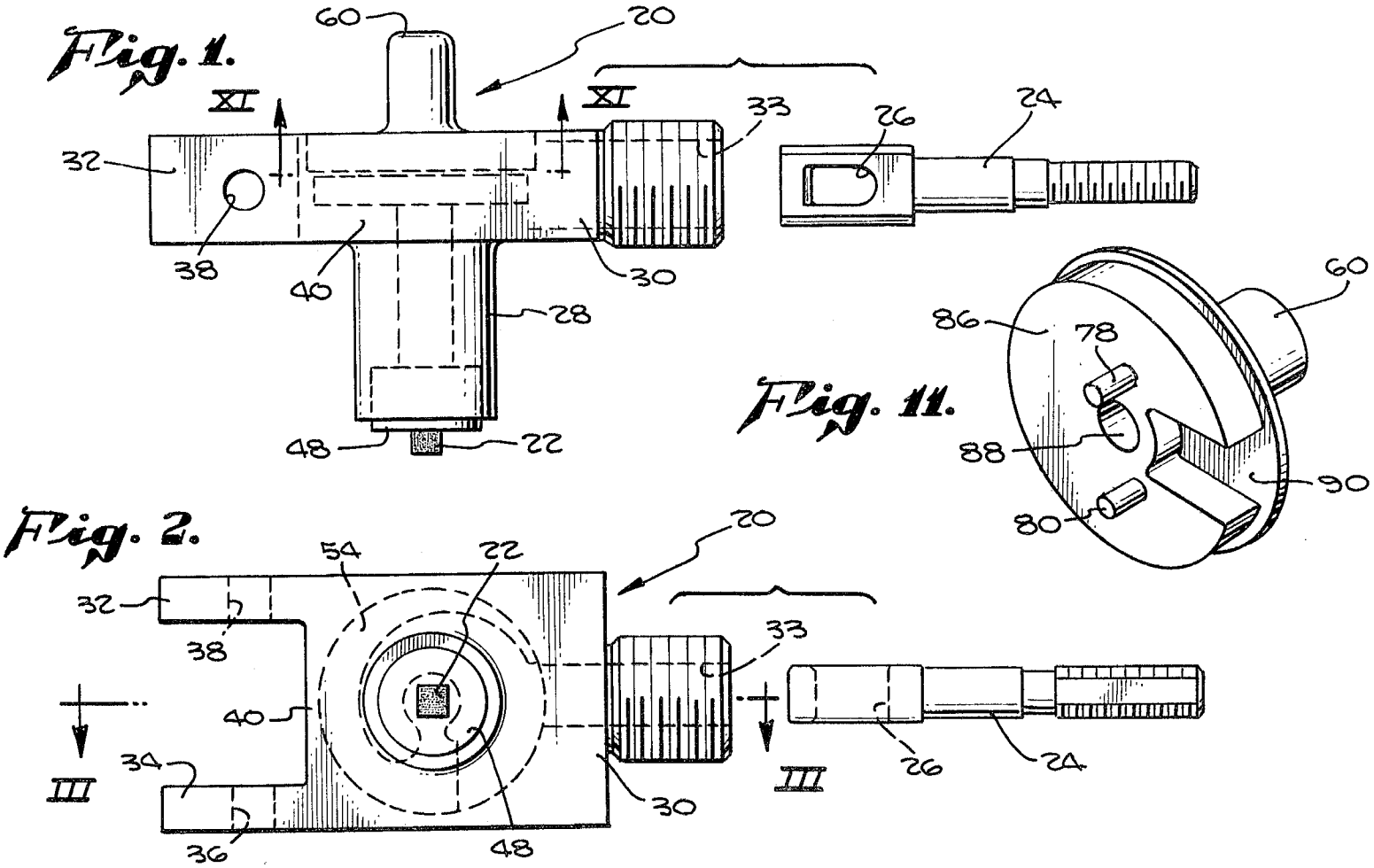
FIG. 1 is a top view of the latch mechanism of the present invention and a conventional eyebolt to which it may be latched.
FIG. 2 is a side view of FIG. 1.
FIG. 11 is a view showing an interior portion of the latch mechanism taken along lines XI—XI of FIG. 1 with portions omitted for convenience of illustration.

FIG. 1 shows the preferred latching mechanism of the present invention generally at 20. The latch mechanism 20 is shown in the unlocked position with the indicator means flag 22 in its extended or protruding position. A conventional keeper pin or latch member such as eyebolt 24 is provided for latching to the latch mechanism 20. The eybolt 24 has an orifice 26 for connection to the latch mechanism 20.

Figure 3:
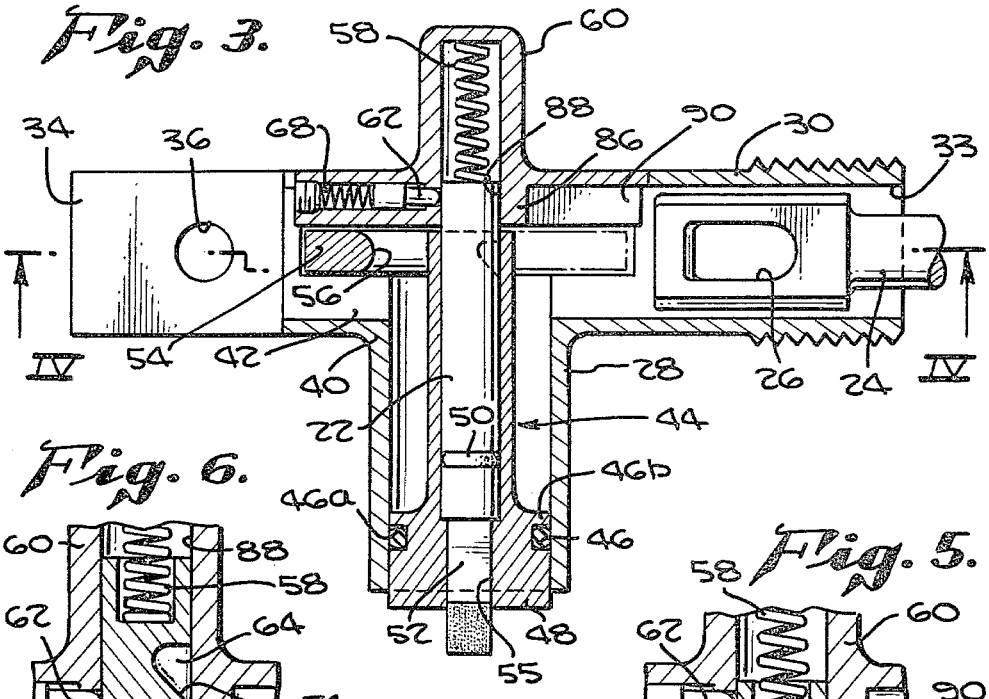
FIG. 3 is a cross-sectional view of FIG. 2 taken in the III—III plane.

Referring now to FIG. 3, the preferred latch mechanism 20 has a main housing 28. The housing 28 has a keeper pin entry arm 30 which defines opening 33 through which the eybolt 24 may be inserted into the latch mechanism 20 for latching. The housing 28 is also provided with mounting arms 32 and 34 (See also FIG. 2). The mounting arms 32 and 34 have holes 36 and 38 respectively which are utilized for mounting the latch mechanism 20 via mounting arms 32 and 34 to desired structures.

The central portion of the housing 40 defines a central chamber 42 which houses the rotor assembly shown generally at 44. The rotor assembly 44 is rotatably journaled within the housing by way of an O-ring 46 disposed in an annular cavity **46*a* at one end 46*b* of assembly 44. Other means may be employed for journaling the rotor assembly 44 within the housing 28 such as bearings and bushings; however, a rubber O-ring is preferred because it provides a given amount of resistant to rotation, thereby preventing inadvertent rotation of the rotor assembly 44**.

The rotor assembly 44 includes a flag housing 48 which contains the flag 22 which is slidably mounted longitudinally within the flag housing 48. Flag O-ring 50 is provided for allowing smooth, nonbinding slidable movement of the flag 22 within the flag housing 48. The flag has an exterior portion 52 which is square in shape for mating with a rectangular opening 55 in the flag housing 48. This restricts movement of the flag 22 and flag housing 48 to common movement only.

Figure 4:
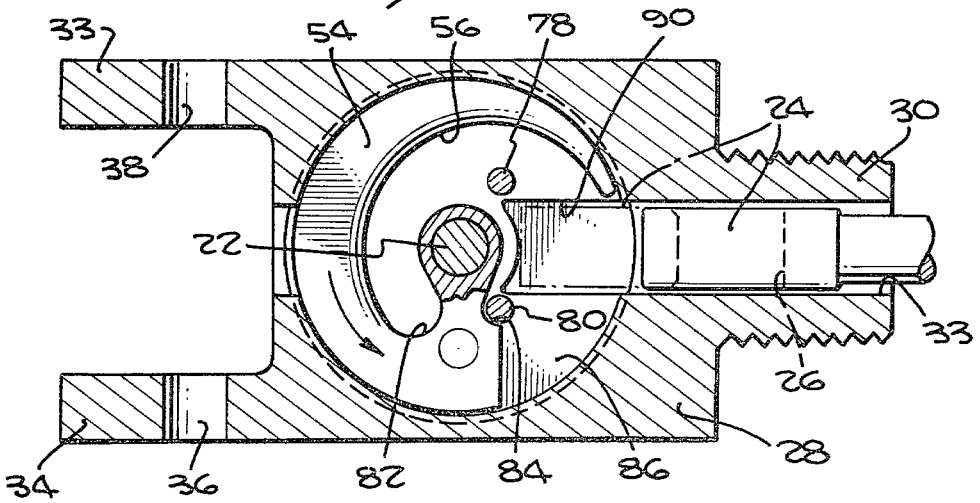
FIG. 4 is a cross-sectional view of FIG. 3 taken in the IV—IV plane.
Figure 10:
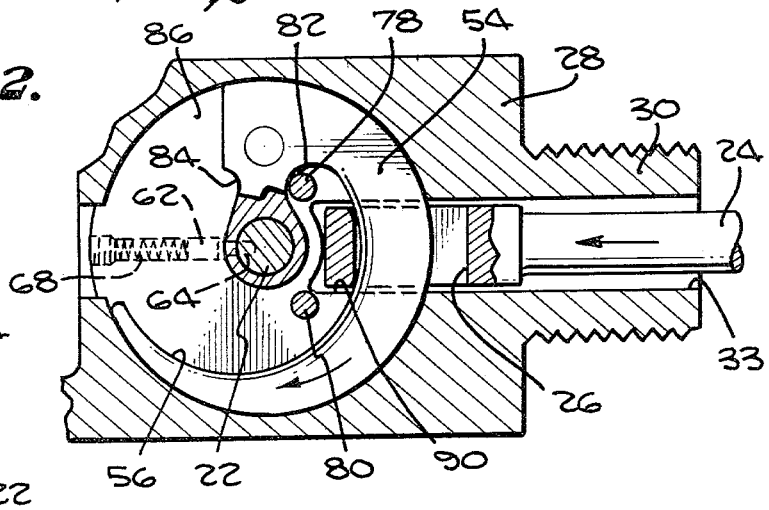
FIG. 10 is a cross-sectional view of FIG. 9 taken in the X—X plane.

The rotor assembly 44 has an interior movable member or latching surface in the preferred form of a circular latch 54. Circular latch 54 is attached to the flag housing 48 by any suitable means, such as by press-fitting thereon. Rotation of the circular latch 54 is accomplished by rotating the rotor housing 48. The circular latch 54 may be rotated between an unlocked or retracted position as shown in FIG. 4 and a fully locked or unretracted position as shown in FIG. 10. The circular latch 54 has an inner arcuate surface 56 which spirals inward toward the flag housing 48. It can be appreciated that, as the circular latch 54 moves into engagement with the eybolt 24 (FIG. 4), it pulls the eybolt in a direction toward the flag housing 48 as the circular latch 54 is rotated to its fully locked position (FIG. 10).

Figure 9:
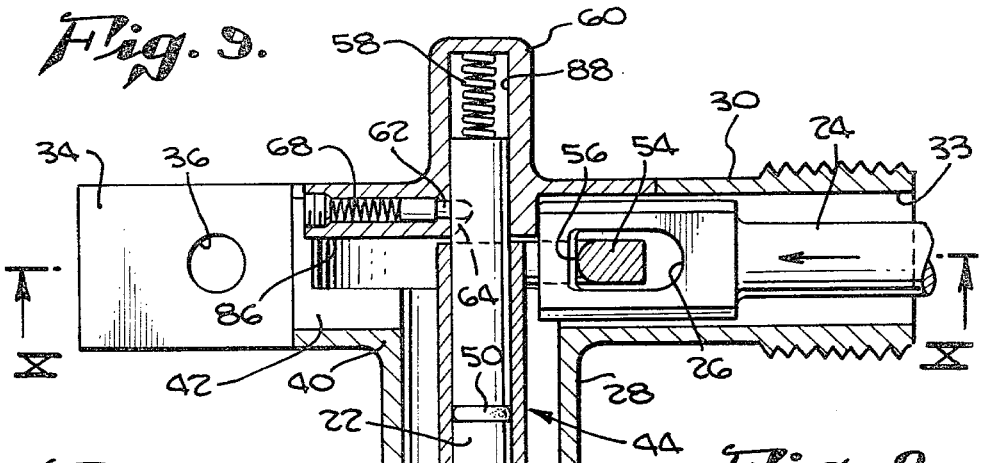
FIG. 9 is a cross-sectional view of the latching mechanism of the present invention in the locked position.

Means for biasing the flag 22 to an extended position, where it is visible externally of the latch 54 is provided by spring 58. Spring 58 is contained within a spring housing 60 on housing 28. The flag biasing spring 58 maintains the flag 22 in the extended position except when the latch 54 is in the fully locked position as shown in FIG. 10. In FIG. 9, the flag 22 is coupled to the housing 28 wherein the flag 22 does not protrude from the flag housing 48 and is not visible externally of the housing 48.

Figure 12:
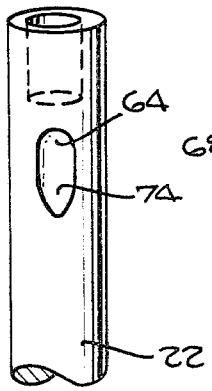
FIG. 12 is a perspective view of the flag of FIG. 6.

Coupling means for coupling the flag 22 to the housing 28 includes plunger 62 which is slidable into an indention or notch 64 (see also FIGS. 5 and 6) in the flag 22. The plunger has a rounded tip 66 for allowing smooth entry into and exit from the notch 64. The notch is shaped so that the plunger 62 fits relatively tightly within the notch. The preferred configuration of the notch 64 is shown in FIG. 12.

The plunger 62 is provided with biasing means for biasing it into notch 64. The preferred biasing means is a spring 68. Spring 68 forces plunger 62 into notch 64 when the plunger 62 and notch 64 are in alignment.

When the plunger 62 is inserted into the notch 64, two things are accomplished. First, the flag 22 is held in a recessed position indicating that the latch mechanism 20 is in the fully locked position. Second, the plunger 62 prevents rotation of the circular latch 54 from its fully locked position. As can be seen from the foregoing discussion, the invention, as particularly contemplated, comprises rotation preventing means for preventing anadvertent rotation of said rotor assembly 44 to its unlocked position. Such rotation preventing means, in the exemplary embodiment, preferably includes plunger 62 and notch 64 and the described means for operating the same.

Rotation of the entire rotor assembly 44, including the circular latch 54, flag housing 48 and flag 22, is accomplished by way of a key 70 (FIG. 9). The key 70 has a mating portion 72 which may be inserted within flag housing opening 55 to act as a wrench in rotating the entire rotor assembly 44.

Figure 6:
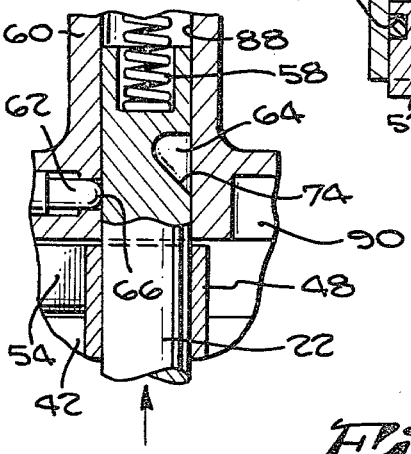
FIG. 6 is also a detailed view of FIG. 3 showing the coupling means when the flag is in the recessed position.
Figure 5:
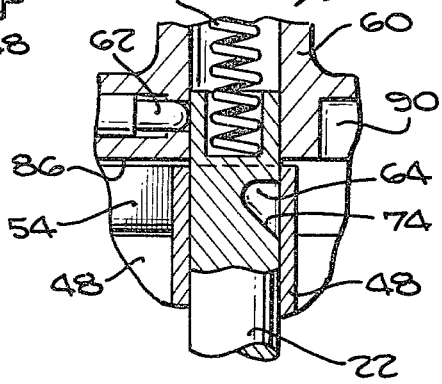
FIG. 5 is a detailed view of FIG. 3 showing the coupling portion of the latch mechanism of the present invention when the flag is in an extended position.
Figure 7:
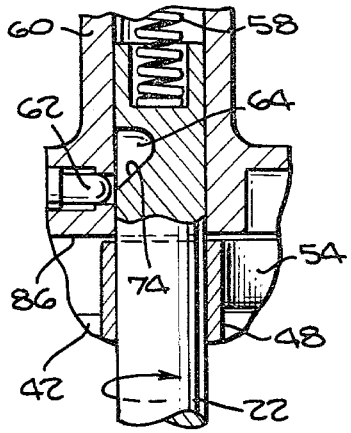
FIG. 7 is a detailed view showing the coupling means in an uncoupled position.
Figure 8:
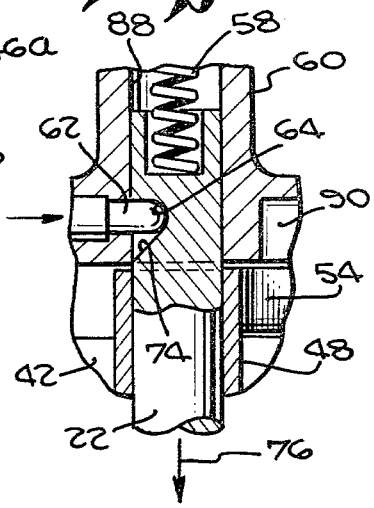
FIG. 8 is a detailed view of FIG. 3 showing the coupling means in the coupled position.

Insertion of the key into the flag housing opening 55, when the circular latch 54 is in the unlocked position, results in a plunger-notch relationship as shown in FIG. 6. As the circular latch 54 is rotated to its fully locked position, the plunger-notch relationship becomes that shown in FIG. 7. As the key 70 is removed from the flag housing opening 55, the plunger 62 moves into the notch 64 (as shown in FIG. 8) thereby preventing movement of the flag to its extended position as shown in FIG. 5.

With the latch in the fully locked position, the flag is maintained in a recessed position not visible externally of the latch and rotation of the latch is prevented by the plunger 62 being inserted in the notch 64. In order to provide a latch which is fully operable, means for disengaging the latch from this fully locked position must be available.

Disengaging means for disengaging the flag is provided by sloping surface 74 of the notch 64. To disengage the latch mechanism, the key is inserted in a direction opposite that of arrow 76 in FIG. 8. As the key 70 is inserted to force the flag 22 to the position shown in FIG. 7, the plunger 62 is gradually moved out of notch 64 by way of the sloping surface 74. Once the key has been inserted as shown in FIG. 7, the circular latch 54 may be rotated to its unlocked position as shown in FIG. 6. Once in the unlocked position or any position other than the fully locked position, the key may be removed with the flag being spring biased by spring 58 to its extended position as shown in FIG. 5.

The movement of circular latch 54 between locked and unlocked positions is positively controlled by pins 78 and 80 (FIG. 4). Pin 78 abuts against inner arcuate surface 56 at 82 to prevent the circular latch 54 from rotating past its fully locked position. Pin 80 abuts against the circular latch 54 at 84 to prevent the circular latch 54 from rotating past the fully unlocked position.

The pins 78 and 80 are connected to a base 86 (FIG. 11) which forms part of the housing 28. The base 86 has a circular opening 88 which slidably receives the flag 22. This opening not only allows slidable movement of the flag 22, but also serves to journal the rotor assembly 44 within the housing. The base 86 is also provided with a rectangular opening 90 which positions and guides the eyebolt 24 as it is inserted into the housing 28 for latching.

It can be seen that the only way in which the flag 22 can remain in a position not visible externally of the latch mechanism 20 is to have plunger 62 inserted within notch 64. Since plunger 62 can only be inserted within notch 64 when the circular latch 54 is in the fully locked position, this preferred latch does not have a "dead spot." Additionally, the plunger-notch configuration provides for a safe, simple and dependable means for coupling the rotor assembly 44 to the housing 28 thereby preventing inadvertent rotation of the circular latch 54 from its fully locked position. This is in contrast to prior art indicator devices which utilize complicated spring-biased camming members and L-shaped arms which may be subject to "dead spots" and mechanical failure.

Of course, many variations to the present disclosure could be made without departing from the scope of the present invention. By way of example, the exterior portion 52 of the flag 22 preferably forms a red square rod protruding from the latch. Certainly, other types of indicator means could be used such as light bulbs or possibly audio-indicators. Also, the means for biasing the plunger 62 and flag 22 could range from simple manual biasing means to electromagnetic biasing means.

The above examples are given by way of illustration only and are not intended to limit the spirit and scope of the invention which is defined in the following claims.

What is claimed is:

1. A latch mechanism which comprises:

a housing;

a rotor assembly rotatably journaled within said housing and rotatable between fully locked and unlocked positions, said rotor assembly having an interior latching surface and an exterior surface;

a flag mounted in longitudinally slidable relation with said rotor assembly, said flag having an exterior portion and an interior end and slidable between recessed and extended positions wherein rotation of said flag is restricted to common rotation with said rotor assembly;

biasing means for normally biasing said flag to said extended position wherein said exterior portion extends out of said rotor assembly;

coupling means for coupling said flag to said housing to prevent rotatable movement of said flag and rotor assembly only when said rotor assembly is in said fully locked position and said exterior portion of said flag is not visible externally of said rotor assembly, said coupling means including a plunger slidably mounted within said housing substantially perpendicular to said flag and slidable between flag engaged and flag disengaged positions, biasing means for biasing said plunger to said flag engaged position and a single indention having a bottom and wall located on said flag for receiving said plunger only when said rotor is in said fully locked position and said exterior portion of said flag is not visible externally of said rotor assembly; and disengaging means for disengaging said flag from said housing.

2. The latch mechanism according to claim 1 wherein said disengaging means comprise a portion of said indention wall sloping outwardly from said indention bottom wherein slidable movement of said flag slidably and downwardly within said rotor assembly automatically disengages said plunger from said indention thereby disengaging said plunger from said flag.

3. The latch mechanism according to claim 2 wherein said outwardly sloping portion of said indention wall is located toward the exterior end of said flag wherein movement of said flag to said recessed position slidably removes said plunger from said indention.

4. The latch mechanism according to claim 3 wherein said flag biasing means is a spring in biasing relation with the interior end of said flag for normally biasing the flag to the flag extended position except when said rotor assembly is in the locked position and said plunger is in the engaged position with said flag.

5. The latch mechanism according to claim 4 wherein said means for biasing said plunger is a spring.

6. The latch mechanism according to claim 1 wherein the portion of said flag protruding from said rotor assembly when said flag is in the extended position has a color which contrasts with said housing and said rotor assembly.

7. The latch mechanism according to claim 6 in which the color of said protruding portion of said flag is red.

8. The latch mechanism according to claim 7 wherein a key is provided for manually moving said flag to said recessed position and for rotating said rotor assembly between unlocked and fully locked positions.

9. The latch mechanism according to claim 8 in which said key is secured to said flag.

10. The latch mechanism according to claim 9 wherein said plunger defines a circular rod having a substantially round end for engaging said indention in said flag.

11. A latch mechanism comprising:

a housing;

a rotor assembly mounted in said housing and movable between a fully locked and an unlocked position;

indicator means coupled to said rotor assembly having a first portion visible externally of said rotor assembly only when said assembly is in the fully unlocked position, said first portion being visible externally of said rotor assembly only when said assembly is in the fully locked position, means on said housing adapted to engage said indicator means when in the fully locked position; and said indicator means including a keyway and an indicator engageable by said last mentioned means, said indicator being slidable within said keyway and said keyway being adapted to receive a tool therein in abutting relationship with said indicator whereby insertion of said tool into said keyway when said rotor assembly is in the locked position forces said indicator downwardly within said rotor assembly thereby disengaging said indicator from said means on said housing to unlock the latching mechanism.

12. In the latching mechanism of claim 11 further including rotation preventing means for preventing rotation of said rotor assembly to its unlocked position when said first portion is not visible externally of said rotor assembly to thereby prevent inadvertent rotation of said rotor assembly until said first portion is moved to a position visible externally of said rotor assembly.

13. The latching mechanism of claim 12 wherein said rotor assembly includes a movable member which moves between a retracted and unretracted position whereby said movable member is adapted to engage a latch member when said rotor assembly is in its fully locked position.

14. In the latch mechanism of claim 1 further including rotation limiting means independent of said coupling means for limiting the rotation of the rotor assembly between its locked and unlocked positions for preventing overtorqueing of the same.

15. In the latch mechanism of claim 14 wherein said rotor rotation limiting means includes a pair of spaced pins on said housing extending into abutting engagement with said rotor assembly.

* * * * *